US005753876A

United States Patent [19]

Lanning

[11] Patent Number: 5,753,876

[45] Date of Patent: May 19, 1998

[54] CLAD END SEAL FOR VACUUM INTERRUPTER

[75] Inventor: Scott Ray Lanning, Elmira, N.Y.

[73] Assignee: Eaton Corporation, Cleveland, Ohio

[21] Appl. No.: 641,711

[22] Filed: May 2, 1996

[51] Int. Cl.[6] ..... H01H 33/66

[52] U.S. Cl. ..... 218/134

[58] Field of Search ..... 218/134, 154, 218/129, 128, 130, 122, 123, 126, 118

[56] References Cited

U.S. PATENT DOCUMENTS

| | | | |
|---|---|---|---|
| 4,081,640 | 3/1978 | Rich | 200/144 B |
| 4,553,002 | 11/1985 | Slade | 200/144 B |
| 4,600,139 | 7/1986 | Murase | 228/184 |
| 4,707,577 | 11/1987 | Tamaki et al. | 200/144 B |

*Primary Examiner*—Adolf Berhane
*Attorney, Agent, or Firm*—Martin J. Moran

[57] ABSTRACT

A clad end seal for a vacuum interrupter comprises a disk-shaped base portion made of at least two clad metal layers and a cylindrical sidewall portion extending therefrom comprising one of the metal layers. The base portion provides strength and stiffness, while the sidewall portion provides stress isolation between the insulating tube of the vacuum interrupter and the base of the clad end seal. The metal sidewall has a relatively low yield strength and a thin section which reduces the risk of fracture when the end seal is brazed to the vacuum interrupter insulating tube. The clad end seal is produced by forming a clad sheet into a cup-shaped article, followed by removal of the outer metal layer from the cylindrical sidewall. The resultant clad end seal comprises a unitary component which eliminates the problems associated with conventional multi-component end seals.

24 Claims, 3 Drawing Sheets

FIG. 3
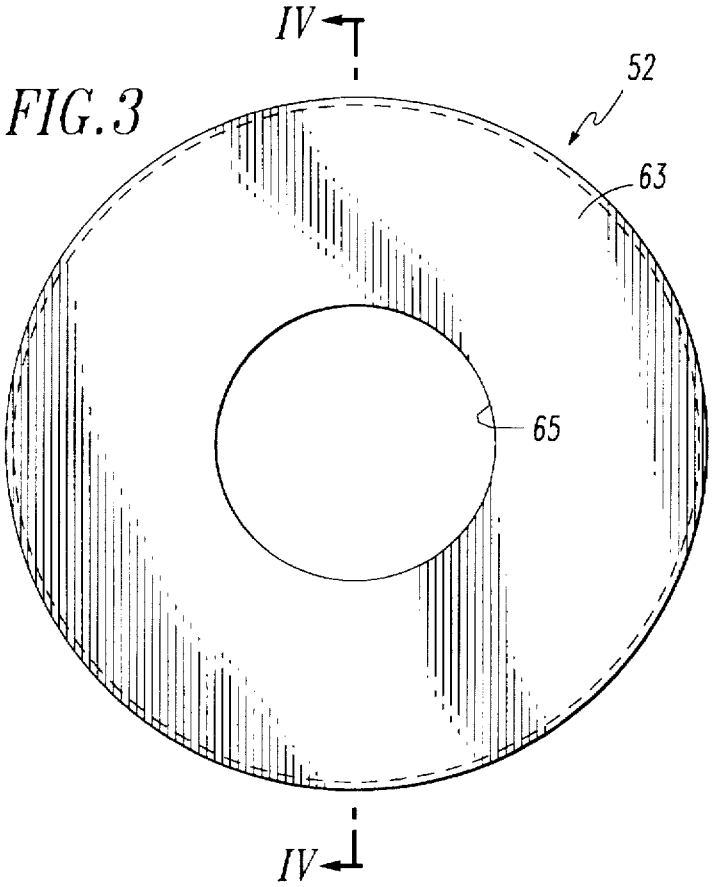
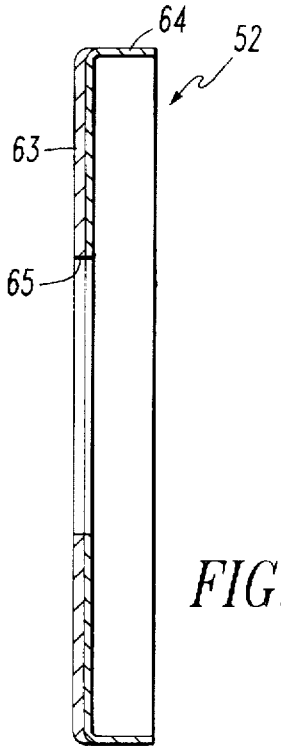
FIG. 4
FIG. 5
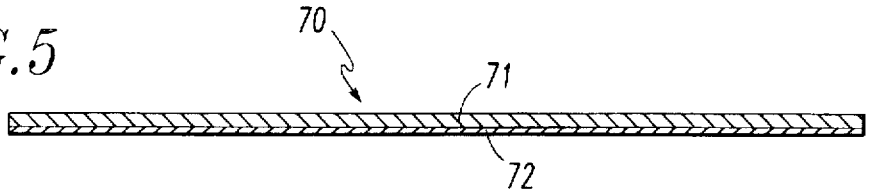
FIG. 6
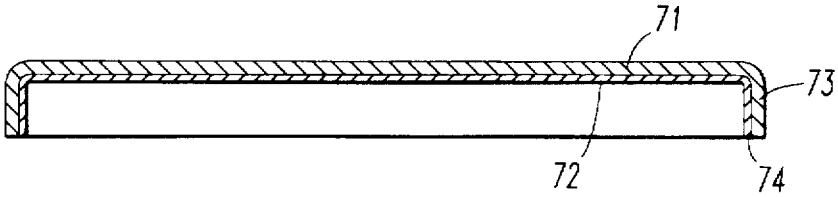
FIG. 7
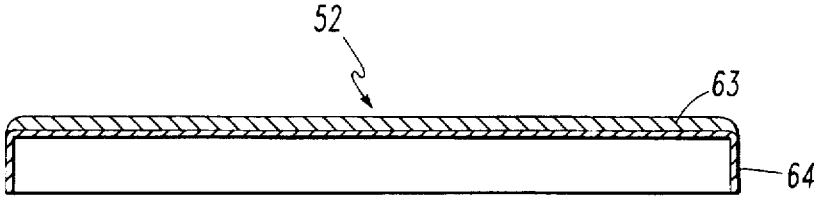

CLAD END SEAL FOR VACUUM INTERRUPTER

BACKGROUND OF THE INVENTION

1. Field of the Invention

The present invention relates to vacuum interrupters, and more particularly relates to a clad end seal for such interrupters.

2. Background Information

Vacuum interrupters are typically used to interrupt high voltage AC currents. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to an AC circuit.

An arc is typically formed between the contact surfaces when the contacts are moved apart to the open circuit position. The arcing continues until the current is interrupted. Metal from the contacts that is vaporized by the arc forms a neutral plasma during arcing and condenses back onto the contacts and also onto vapor shields placed between the contact assemblies and the vacuum envelope after the current is extinguished.

The vacuum envelope of the interrupter typically includes a ceramic tubular insulating casing with a metal end cap or seal covering each end. The electrodes of the vacuum interrupter extend through the end caps into the vacuum envelope. At least one of the end caps is rigidly connected to the electrode and must be able to withstand relatively high dynamic forces during operation of the interrupter. Thus, the end seals must have sufficiently high strength and stiffness. In addition, since the end seals are joined to the tubular insulating casing by means such as brazing, the vacuum envelope must be capable of withstanding stresses caused by differential thermal expansion between the insulating tube and the metal end seals.

In order to provide high strength and stiffness to withstand the high dynamic forces and also to provide relatively low strength adjacent to the insulating tube to yield and relieve stresses due to differences in thermal expansion, conventional vacuum interrupter end seals comprise different metal components that are joined together. For example, the end seal may comprise a high-strength stainless steel disk joined to a low-strength CuNi annular member, which in turn is joined to the insulating tube. In such designs, the high strength metal is joined to the low strength metal by techniques such as brazing. However, such joining techniques represent additional assembly steps and fixturing which add to the cost of the product. Moreover, conventional brazed joints often leak and require testing prior to being placed into operation. Brazing repair operations are often necessary in order to fix faulty joints. In some cases, leaks may not be detected during the initial testing and may only appear after the vacuum interrupter has been completely assembled, in which case the entire interrupter assembly is likely to be scrapped.

A need therefore exists for vacuum interrupter end seals that can be easily fabricated and assembled, and which reduce or eliminate the rejection of parts due to leakage.

SUMMARY OF THE INVENTION

In accordance with the present invention, a vacuum interrupter clad end seal is provided as a unitary component having a disk-like base portion with a cylindrical sidewall extending therefrom. The base portion includes two metal layers clad together to provide high strength and stiffness, while the sidewall portion preferably includes a single metal layer of relatively low strength. The sidewall is a material that has good brazing characteristics with the brazing filler metal and insulating tube, and can be brazed to the end of a vacuum interrupter insulating tube without fracturing the tube when the brazed joint contracts upon cooling. The relatively low strength of the sidewall metal also provides stress isolation between the insulating tube and the stiff base portion of the clad end seal. The end seal is produced by forming a clad sheet into a cup-like article having the high strength metal on the exterior thereof and the low strength metal on the interior thereof. The high strength metal is then removed from the exterior sidewall of the article by machining or the like. The resultant end seal thus comprises a single component having the desired base and sidewall properties without the necessity of forming a brazed joint therebetween.

An object of the present invention is to provide an improved end seal for a vacuum interrupter.

Another object of the present invention is to provide a vacuum envelope for a vacuum interrupter or other vacuum tube device such as a capacitive tuner or power tube, including an insulating tube and end seals joined to the ends of the insulating tube. The end seal includes a substantially disk-shaped base portion including at least two layers of different metals, and a substantially cylindrical sidewall portion comprising one of the metal layers which extends from the base portion.

Another object of the present invention is to provide a method of making a monolithic end seal for a vacuum interrupter, including the steps of providing a clad sheet having a first metal layer clad to a second metal layer, forming the clad sheet into a shaped article having a substantially disk-shaped base portion with a substantially cylindrical sidewall portion extending therefrom, and removing the second metal layer from the sidewall portion.

BRIEF DESCRIPTION OF THE DRAWINGS

FIG. 3 is an end view of a clad end seal of the present invention.

FIG. 4 is a side sectional view of the end clad seal shown in FIG. 3.

FIGS. 5–7 are side sectional views showing various stages in the production of the end clad seal of the present invention.

DESCRIPTION OF THE PREFERRED EMBODIMENT

Figure 1:
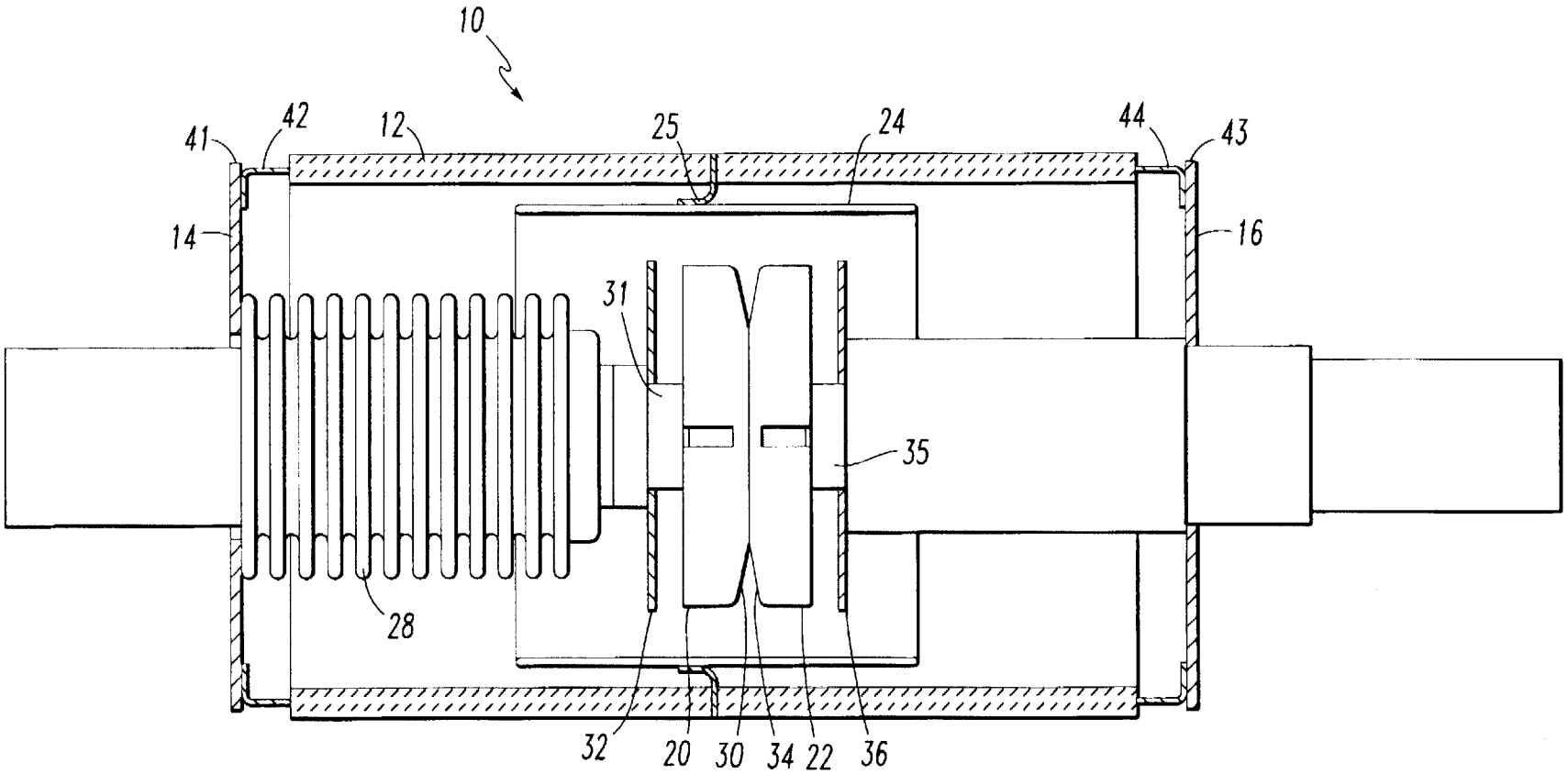
FIG. 1 PRIOR ART
FIG. 1 shows a typical prior art vacuum interrupter including multi-component end seals having brazed joints.

Referring to the figures wherein like reference numbers represent like elements throughout the several drawings, FIG. 1 shows a typical prior art vacuum interrupter 10 including a cylindrical insulating tube 12 and end seals 14 and 16. Electrode assemblies 20 and 22 are longitudinally aligned within a vacuum envelope formed by the insulating tube 12 and end seals 14 and 16. A cylindrical vapor shield 24 surrounds the electrode assemblies 20 and 22 to prevent metal vapors from collecting on the insulating tube 12. A support flange 25 secures the vapor shield 24 to the insulating tube 12.

The electrode assemblies 20 and 22 are axially movable with respect to each other for opening and closing the AC circuit. A bellows 28 mounted on the electrode assembly 20 seals the interior of the vacuum envelope formed by the insulating tube 12 and end seals 14 and 16, while permitting movement of the electrode assembly 20 from a closed position as shown in FIG. 1 to an open circuit position (not shown). The electrode assembly 20 includes an electrode contact 30 connected to a generally cylindrical terminal post 31 which extends out of the vacuum envelope through a hole in the end seal 14. A contact vapor shield 32 is mounted on the terminal post 31 in order to keep metal vapors off the bellows 28. Likewise, the electrode assembly 22 includes an electrode contact 34 connected to a generally cylindrical terminal post 35 which extends through the end seal 16. A contact vapor shield 36 is mounted on the terminal post 35 to protect the insulating tube 12 from metal vapors. The terminal post 35 is rigidly sealed to the end seal 16 by means such as welding or brazing.

Each of the end seals 14 and 16 comprises two metal components that are joined together by brazing. The end seal 14 includes a disk-shaped component 41 and an annular component 42. Similarly, the end seal 16 includes a disk-shaped component 43 and an annular component 44. Each of the disk-shaped components 41 and 43 is made of a high-strength, high-stiffness metal such as stainless steel. The stainless steel of the disk-shaped components is capable of withstanding relatively high axial loads transferred through the terminal posts 31 and 35. The disk-shaped components 41 and 43 must be relatively stiff in order to prevent deflections which can cause the electrode assemblies to be tilted or off center which results in nonuniform pressure on the mating faces of the electrodes when electrical contact is made.

The annular components 42 and 44 are brazed to the disk-shaped components 41 and 43, respectively. The annular components 42 and 44 are also joined to the insulating tube 12 by means such as brazing. The annular components 42 and 44 are made of a relatively low-strength alloy such as CuNi comprising 68% Cu. The use of such a low-strength alloy is necessary in order to isolate stresses which would otherwise be transferred from the rigid disk-shaped component to the insulating tube. During assembly of the vacuum interrupter, the brazing operation for joining the end seal to the insulating tube causes the stainless steel of each disk-shaped component 41 and 43 to expand much more than the ceramic of the insulating tube 12. Upon cooling, the stainless steel contracts more than the ceramic, thereby inducing stress in each of the components. By using a relatively thin annular component comprising a relatively low yield strength alloy such as CuNi, it will deflect and relieve some of the stress, thereby preventing potential fracture of the ceramic insulating tube 12.

Thus, prior art vacuum interrupters as shown in FIG. 1 require multiple-component end seals made of different materials which function in a different manner. A high strength and high stiffness material such as stainless steel is required to prevent unwanted tilting, axial misalignment and axial movement of the electrode assemblies, while a low strength material is required to isolate stresses which could otherwise fracture the ceramic insulating tube. A major disadvantage of such multi-component end seals is that they must be joined by techniques such as brazing, which adds to fabrication costs and often results in leakage.

Figure 2:
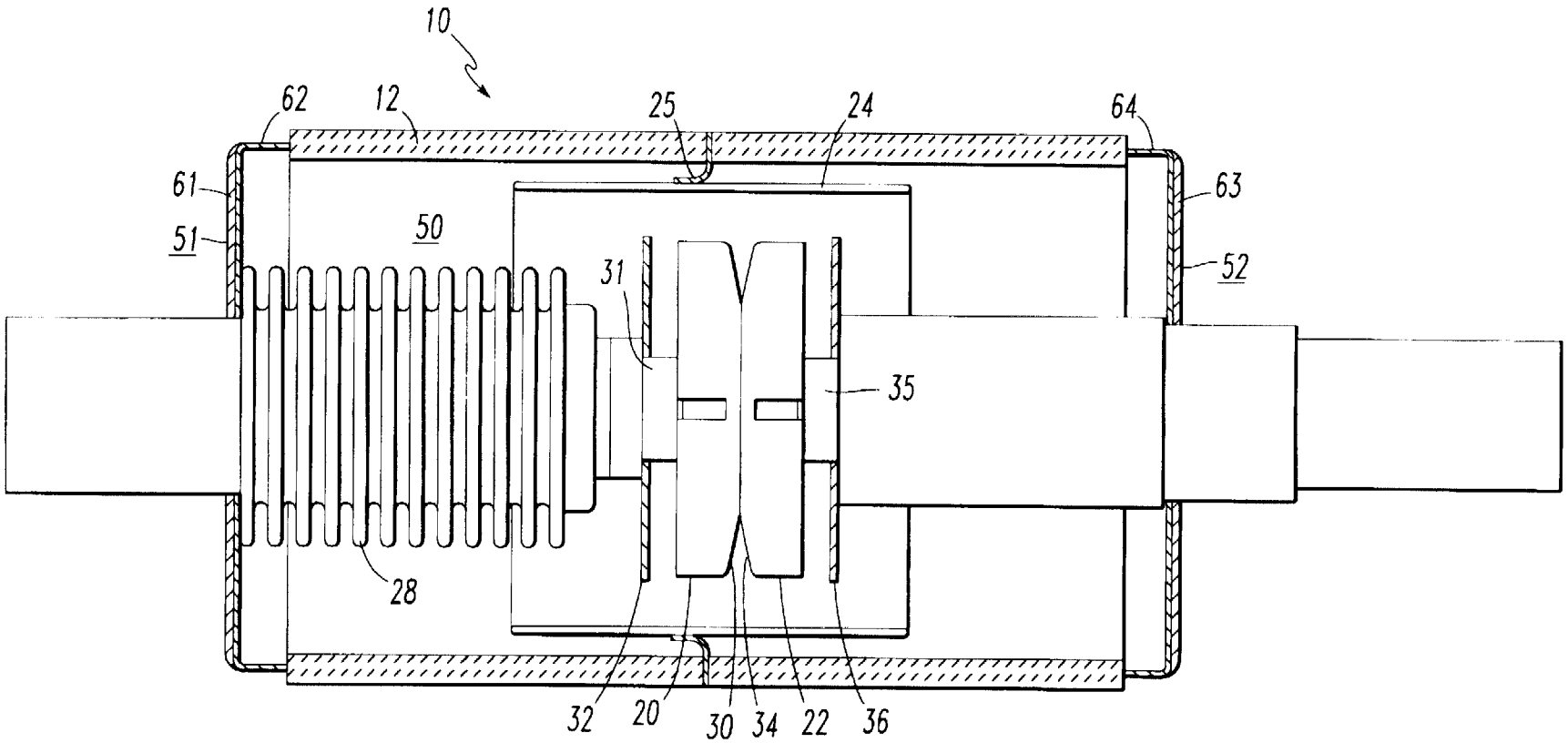
FIG. 2 is a sectional view of a vacuum interrupter including clad end seals in accordance with the present invention.

FIG. 2 shows a vacuum interrupter 10 having clad end seals 51 and 52 in accordance with the present invention. The vacuum interrupter 10 includes a cylindrical insulating tube 12 which, in combination with the clad end seals 51 and 52, forms a vacuum envelope 50. The insulating tube 12 supports a vapor shield 24 by means of a flange 25. The insulating tube 12 is preferably made of a ceramic material such as alumina, zirconia or other oxide ceramics. The electrode assembly 20 includes a bellows 28, electrode contact 30, terminal post 31, and vapor shield 32. The electrode assembly 22 includes an electrode contact 34, terminal post 35, and vapor shield 36. While the vacuum envelope 50 shown in FIG. 2 is part of a vacuum interrupter 10, it is to be understood that the term "vacuum envelope" as used herein is intended to include any sealed component having a ceramic to metal seal which forms a substantially gas-tight enclosure. Such sealed enclosures may be maintained at sub-atmospheric, atmospheric or super-atmospheric pressures during operation.

In accordance with the present invention, the clad end seal 51 includes a clad base 61 and machined sidewall 62, as more fully described below. Similarly, the clad end seal 52 includes a clad base 63 and machined sidewall 64. The clad base 63 of the clad end seal 52 is rigidly sealed to the terminal post 35 of the electrode assembly 22 by means such as brazing. The machined sidewall 64 is joined to the insulating tube 12 by means such as brazing. The sidewall 62 of the clad end seal 51 is likewise joined to the insulating tube 12 by brazing or the like. The clad base 61 of the clad end seal 51 is sealed to the bellows 28 by means such as brazing in order to prevent leakage between the interior and exterior of the vacuum envelope 50 formed by the insulating tube 12 and end seals 51 and 52.

When the electrode assemblies 20 and 22 come in contact upon opening and closing as shown in FIG. 2, substantial axial loads are transferred through the terminal posts 31 and 35 to the clad bases 61 and 63 of the clad end seals 51 and 52. The clad bases 61 and 63 must therefore be sufficiently strong and stiff in order to prevent unwanted deflection of the end seals 51 and 52. Such deflection could cause the electrode assemblies 20 and 22 to tilt with respect to each other or to become axially misaligned, and could also cause the movable electrode assembly 20 to push the fixed electrode assembly 22 toward the right in FIG. 2. If the electrode assemblies are tilted or misaligned, nonuniform pressure is applied between the mating surfaces of the contacts, resulting in higher current densities in the areas that are in contact. Such higher current densities produce higher temperatures and higher resistance. In addition, substantial deflection of the clad base 63 can lead to the appearance of premature contact erosion because the movable electrode assembly 20 is inserted a greater distance into the vacuum envelope. Thus, it is essential that the clad base 63 of the clad end seal 52 is sufficiently strong and stiff to prevent an undesirable amount of deflection. On the other hand, the machined sidewall 64 of the clad end seal 52 must be sufficiently flexible to relieve stresses between the clad end seal 52 and insulating tube 12, which could otherwise fracture the ceramic insulating tube. The machined sidewall 62 must likewise be sufficiently flexible to isolate stresses between the clad end seal 51 and insulating tube 12, which could fracture the ceramic insulating tube.

In accordance with the present invention, each clad base 61 and 63 preferably comprises an outer layer of relatively strong and stiff metal, such as 304 stainless steel and an inner layer of relatively flexible metal such as a CuNi alloy comprising 68% Cu. Both the inner and outer layers are preferably non-magnetic in order to prevent inductive heating in the clad end seals caused by current flowing through the electrode assemblies 20 and 22.

In accordance with a preferred embodiment of the present invention, each of the machined sidewalls 62 and 64 comprises an extension of the inner layer of the clad base having a slightly lower degree of thermal expansion than the outer layer of the clad base. For example, the inner layer may have a coefficient of thermal expansion less than about $9.5\times10^{-6}$ in/in/°F., while the outer layer may have a coefficient of thermal expansion greater than $10\times10^{-6}$ in/in/°F. Thus, when the machined sidewalls 62 and 64 are joined to the insulating tube 12 by means such as brazing, residual stresses are lowered by reducing the coefficient of thermal expansion of the sidewall material to a level that is more compatible with the thermal expansion of the insulating tube. However, the difference in thermal expansion coefficient between the inner and outer layers should not be so large as to result in substantial bending of the clad base during the brazing cycle. In addition, the machined sidewalls 62 and 64 are preferably relatively thin in order to allow sufficient deflection to reduce the stress at the interface of the machined sidewall and insulating tube, to thereby prevent fracture of the insulating tube.

FIGS. 3 and 4 show end and cross-sectional views, respectively, of a clad end seal 52 in accordance with the present invention. The clad end seal 52 includes a clad base 63 and a machined sidewall 64. The clad base 63 has a circular hole 65 which allows the terminal post 35 to pass through the clad end seal 52 when the vacuum interrupter is assembled, as shown in FIG. 2. As shown most clearly in FIG. 4, the machined sidewall 64 comprises a generally cylindrical metal wall that is formed out of the plane of the clad base 63.

FIGS. 5–7 illustrate the formation of a clad end seal 52 in accordance with the present invention. As shown in FIG. 5, a clad strip 70 is provided comprising a relatively thick metal layer 71 bonded to a relatively thin metal layer 72. The clad strip 70 is produced by chemically cleaning the component metals in order to remove surface impurities that would prevent bonding. The component metal sheets are then stacked and compressed with sufficient force to cause the atomic lattices at the interface of the metal sheets to merge. The clad strip is then heat treated to induce electron diffusion and to remove impurities in order to improve bond strength.

The outer layer 71 of the clad strip 70 preferably has a thickness of from about 0.050 to about 0.075 inch, and more preferably from about 0.060 to about 0.062 inch. The outer layer 71 is preferably composed of a relatively strong and stiff metal such as stainless steel, carbon steel, moly steel or nickel iron alloy. The outer metal layer 71 preferably has a yield strength greater than about 70 ksi, for example, from about 70 to about 80 ksi. The modulus of the outer metal layer 71 is preferably greater than about $27\times10^6$ psi, for example, from about $27.6\times10^6$ psi to about $29\times10^6$ psi. A particularly preferred outer layer 71 is composed of 304L stainless steel having a thickness of about 0.062 inch.

The inner layer 72 of the clad strip 70 preferably has a thickness of from about 0.028 to about 0.032 inch, and more preferably from about 0.029 to about 0.031 inch. The inner layer 72 is preferably composed of an alloy such as 68% CuNi, Kovar, Monel, NiFe or 80 cupro nickel. The composition and thickness of the inner layer 72 are selected in order to provide sufficient flexibility once the clad end seal is brazed on the ceramic insulating tube. The inner metal layer 72 preferably has a yield strength less than about 28 ksi, for example from about 25 to about 28 ksi. The modulus of the inner metal layer is preferably about $22\times10^6$ psi. A particularly preferred material for the inner layer 72 is 68% CuNi having a thickness of about 0.030 inch.

As shown in FIG. 6, the clad strip 70 is formed into a cup shape by means such as punching or the like. At this stage, the sidewall of the cup comprises a portion of the outer layer that has been formed 73 and a portion of the inner layer that has been formed 74.

The formed outer layer 73 is then removed from the formed inner layer 74 by any suitable method, such as machining. The resultant component comprises a generally disk-shaped clad base 63 and machined side wall 64, as shown in FIG. 7. The component is preferably machined to provide a radiused comer. A hole may be punched in the center of the clad base 63 to form a clad end seal 52, as shown in FIGS. 3 and 4.

The following example is intended to illustrate various aspects of the present invention, and is not intended to limit the scope thereof.

EXAMPLE

A 5 by 5 inch clad sheet comprising an outer layer of 0.062 inch thick 304L stainless steel bonded to an inner layer of 0.030 inch thick 68% CuNi similar to that shown in FIG. 5 is punched and trimmed into a cup shape similar to that shown in FIG. 6 having a diameter of about 3.90 inch and a sidewall height of about 0.44 inch. A 1.13 inch diameter hole is punched in the center of the clad base. The formed sidewall portion of the stainless steel outer layer is then machined off by clamping the ID of the sidewall or center hole with an expanding mandrel and turning until all of the stainless steel is removed from the sidewall and the CuNi is exposed. The stainless steel corner is machined to about a 0.04 inch radius as shown in FIG. 7.

The clad end seal of the present invention possesses several advantages over conventional brazed end seals as shown in FIG. 1. For example, the clad end seal eliminates brazing repair operations that are required to seal leaks at the brazed metal joint in prior art designs. Even with leak testing, conventional brazed joints often leak after the vacuum interrupter has been assembled, which can result in scrapping of the entire assembly. The present clad end seal also eliminates rejects from misalignment between the metal components. In addition, the clad end seal comprises a reduced number of components and eliminates the requirement of alignment fixtures for assembling multiple components. Furthermore, to prevent external breakdown, the present clad end seal provides better high voltage insulation because it may be provided with a radiused outside corner instead of an overhanging lip of conventional designs. External breakdown occurs when too high a voltage is applied on the open vacuum interrupter and the dielectric strength of the air outside the insulating tube is not enough to hold off the voltage, resulting in the formation of an arc between the metal ends. Such external breakdown is more likely to occur with sharp corners associated with prior art multi-component end seals where an electric field concentration is generated. By providing a radiused outside corner, the preferred clad end seals of the present invention avoid such external breakdown.

While the present invention has been described in terms of certain embodiments, various adaptations, modifications and changes will be apparent to those skilled in the art, and such adaptations, modifications and changes are intended to be within the scope of the present invention, as set forth in the following claims.

What is claimed is:

1. A vacuum envelope comprising:

an insulating tube; and end seals joined to ends of the insulating tube, wherein at least one of the end seals comprises a substantially disk-shaped base portion including at least first and second coextensive clad metal layers with one of the layers extending from the substantially disk-shaped base portion and joined to the end of the insulating tube.

2. The vacuum envelope of claim 1, wherein the insulating tube is made of an oxide ceramic material selected from the group consisting of alumina and zirconia.

3. The vacuum envelope of claim 1, wherein the metal layer extending from the substantially disk-shaped portion comprises a substantially cylindrical sidewall.

4. The vacuum envelope of claim 3, wherein the substantially cylindrical sidewall of the end seal comprises an extension of the first metal layer of the base portion.

5. The vacuum envelope of claim 4, wherein the first metal layer has a yield strength less than the yield strength of the second metal layer.

6. The vacuum envelope of claim 4, wherein the first metal layer has a modulus less than the modulus of the second metal layer.

7. The vacuum envelope of claim 4, wherein the first metal layer has a smaller thickness than the second metal layer.

8. The vacuum envelope of claim 4, wherein the end seal is joined to the end of the insulating tube by brazing.

9. The vacuum envelope of claim 4, wherein the first metal layer comprises a nickel alloy and the second metal layer is selected from the group consisting of stainless steel, carbon steel and moly steel.

10. The vacuum envelope of claim 4, wherein the sidewall is formed from the base portion in a direction substantially perpendicular to a plane defined by the substantially disk-shaped base portion.

11. The vacuum envelope of claim 10, wherein the second metal layer is removed from the sidewall.

12. A clad end seal for a vacuum envelope comprising:

a substantially disk-shaped base portion including a first metal layer clad to a second metal layer; and a substantially cylindrical sidewall portion extending from the base portion and comprising an extension of the first metal layer.

13. The clad end seal of claim 12, wherein the first metal layer has a yield strength less than the yield strength of the second metal layer.

14. The clad end seal of claim 12, wherein the first metal layer has a modulus less than the modulus of the second metal layer.

15. The clad end seal of claim 12, wherein the first metal layer has a coefficient of thermal expansion slightly less than the coefficient of thermal expansion of the second metal layer.

16. The clad end seal of claim 12, wherein the first metal layer comprises a nickel alloy and the second metal layer is selected from the group consisting of stainless steel, carbon steel and moly steel.

17. The clad end seal of claim 12, wherein the sidewall portion is formed from the base portion in a direction substantially perpendicular to a plane defined by the substantially disk-shaped base portion.

18. The clad end seal of claim 17, wherein the sidewall portion is machined.

19. A method of making a clad end seal for a vacuum envelope, the method comprising:

providing a clad sheet comprising a first metal layer clad to a second metal layer;

forming the clad sheet into a shaped article having a substantially disk-shaped base portion with a substantially cylindrical sidewall portion extending therefrom; and removing at least a portion of the second metal layer from the sidewall portion.

20. The method of claim 19, wherein the clad sheet is formed into the shaped article by punching.

21. The method of claim 19, wherein the entire second metal layer is removed from the sidewall portion.

22. The method of claim 19, wherein the second metal layer is removed from the sidewall portion by machining.

23. The method of claim 19, wherein the substantially cylindrical sidewall portion comprises an outer layer of the second metal when the clad sheet is formed into the shaped article.

24. The method of claim 19, further comprising forming a hole substantially in the center of the base portion structured to allow a vacuum interrupter electrode to pass therethrough.

* * * * *